US007154454B2

(12) United States Patent
Okabe et al.

(10) Patent No.: US 7,154,454 B2
(45) Date of Patent: Dec. 26, 2006

(54) SPONTANEOUS LIGHT EMITTING DISPLAY DEVICE

(75) Inventors: Masashi Okabe, Tokyo (JP); Mitsuo Inoue, Tokyo (JP); Shuji Iwata, Tokyo (JP); Takashi Yamamoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 321 days.

(21) Appl. No.: 10/276,159

(22) PCT Filed: Mar. 15, 2002

(86) PCT No.: PCT/JP02/02496

§ 371 (c)(1),
(2), (4) Date: Nov. 13, 2002

(87) PCT Pub. No.: WO02/075712

PCT Pub. Date: Sep. 26, 2002

(65) Prior Publication Data

US 2003/0112208 A1 Jun. 19, 2003

(30) Foreign Application Priority Data

Mar. 21, 2001 (JP) ..... 2001-080427
Aug. 24, 2001 (JP) ..... 2001-253989

(51) Int. Cl.
*G09G 3/30* (2006.01)
*G09G 3/10* (2006.01)

(52) U.S. Cl. ..... 345/76; 315/169.3

(58) Field of Classification Search ..... 345/55, 345/69, 204–206, 76–107, 36; 315/169.1, 315/169.2, 169.3
See application file for complete search history.

(56) References Cited

U.S. PATENT DOCUMENTS

| | | | | |
|---|---|---|---|---|
| RE31,872 | E * | 4/1985 | Cohen | 340/784 |
| 6,404,137 | B1 | 6/2002 | Shodo | |
| 6,424,326 | B1 | 7/2002 | Yamazaki et al. | |
| 6,452,341 | B1 | 9/2002 | Yamauchi et al. | |
| 6,859,193 | B1 * | 2/2005 | Yumoto | 345/82 |
| 2002/0011972 | A1 | 1/2002 | Yamazaki et al. | |
| 2003/0117352 | A1 * | 6/2003 | Kimura | 345/87 |
| 2004/0041750 | A1 * | 3/2004 | Abe | 345/76 |
| 2004/0113872 | A1 * | 6/2004 | Nanno et al. | 345/76 |

FOREIGN PATENT DOCUMENTS

| | | |
|---|---|---|
| EP | 923 067 | 6/1999 |
| JP | 2001-56667 | 2/2001 |
| JP | 2001-67018 | 3/2001 |
| JP | 2001-75524 | 3/2001 |
| JP | 2001-265283 | 9/2001 |
| JP | 2001-292276 | 10/2001 |

* cited by examiner

*Primary Examiner*—Sumati Lefkowitz
*Assistant Examiner*—Srilakshmi K Kumar
(74) *Attorney, Agent, or Firm*—Leydig, Voit & Mayer, Ltd.

(57) ABSTRACT

In a driving circuit of a spontaneous light emitting display device driven as an active matrix, a noise current is prevented from flowing in a light emitting element when compensating for a threshold voltage of a transistor for controlling current flowing to the emitting element, enhancing precision in luminance. A switching element for short-circuiting electrodes of the spontaneous light emitting element for a period in which the noise current flows in the light emitting element bypasses the noise current.

6 Claims, 10 Drawing Sheets

SPONTANEOUS LIGHT EMITTING DISPLAY DEVICE

TECHNICAL FIELD

The present invention relates to a luminance control for a spontaneous light emitting element in a spontaneous light emitting display device using an active matrix method.

BACKGROUND ART

FIG. 7 shows a conventional driving circuit corresponding to one pixel of a spontaneous light emitting type display device using an active matrix method which has been disclosed in the cited reference 'T. P. Brody, et al., "A 6×6—in 20-1 pi Electroluminescent Display Panel", IEEE Trans. on Electron Devices, Vol. ED-22, No. 9, pp. 739–748 (1975)'". Tr1 denotes the first transistor which operates as a switching element. Tr2 denotes the second transistor which operates as a driving element for controlling the current of a spontaneous light emitting element. C1 denotes a capacitor connected to the drain terminal of the first transistor Tr1. A spontaneous light emitting element 60 is connected to the drain terminal of the second transistor Tr2. Next, an operation will be described. First of all, a voltage of a selection line 61 is applied to the gate terminal of the first transistor Tr1. At this time, when luminance data are applied at a predetermined voltage from a luminance data line 62 to a source terminal, a voltage level V1 corresponding to the magnitude of the luminance data is held in the capacitor C1 connected to the drain terminal of the first transistor Tr1. If the magnitude of the voltage level V1 held in the gate voltage of the second transistor Tr2 is enough for causing a drain current to flow, a current corresponding to the magnitude of the voltage level V1 flows from a voltage supply line 63 to the drain of the second transistor Tr2. The drain current becomes the current of the spontaneous light emitting element to emit a light.

FIG. 8 is a characteristic chart for explaining the generation of a variation in a luminance in the case in which the light emission is carried out in such an operation, showing the relationship between a voltage Vgs between a gate and a source of the second transistor Tr2 and the absolute value of a drain current Id. In the case in which it is impossible to produce FETs having the same characteristics over the whole display panel area due to manufacturing factors, for example, a variation shown in FIGS. 8(*a*), 8(*b*) and 8(*c*) is generated in threshold voltage Vt. When the voltage level V1 is applied between the gate and the source of the second transistor Tr2 having such characteristics A, B, and C, the magnitude of the drain current is varied from Id(a) to Id(c). Since the spontaneous light emitting element 60 shown in FIG. 7 emits light with a luminance corresponding to the magnitude of the current, a variation in the characteristic of the second transistor Tr2 causes a variation in a light emitting luminance in the spontaneous light emitting type display device.

FIG. 9 shows a driving circuit proposed to improve a variation in a light emitting luminance in the spontaneous light emitting type display device described above. The driving circuit has been disclosed in 'R. M. A. Dawson, et al., "Design of an Improved Pixel for a Polysilicon Active—Matrix Organic LED Display", SID 98DIGEST, 4. 2, pp. 11–14 (1998)', corresponding to one pixel. FIG. 10 is a waveform diagram showing an operation timing based on the relationship between a time and an applied voltage in the driving circuit. In FIG. 9, reference numeral 1 denotes an organic electroluminescence element which is constituted by a light emitting material and two electrodes interposing the light emitting material and forms a pixel. Reference numeral 2 denotes a selection line for supplying a signal voltage for selecting a pixel over which a luminance control is to be carried out, reference numeral 3 denotes a luminance data line for supplying a voltage corresponding to a luminance, reference numeral 4 denotes the first transistor which is brought into a conduction state or a non-conduction state in response to a signal of the selection line 2, reference numerals 5 and 6 denote the first and the second capacitors for holding a voltage corresponding to the signal voltage component of the luminance data line 3, reference numeral 7 denotes the second transistor for controlling the current value of the organic electroluminescence element 1 corresponding to an electric potential difference Vgs on a point g to a point s, reference numeral 8 denotes the third transistor for connecting or blocking points g and d, reference numeral 9 denotes the first control signal line for supplying a signal voltage for controlling the third transistor 8 into a conduction state or a non-conduction state, reference numeral 10 denotes the fourth transistor for connecting or blocking the organic electroluminescence element 1 and the second transistor 7, and reference numeral 11 denotes the second control signal line for supplying a signal voltage for controlling the fourth transistor 10 into a conduction state or a non-conduction state. Reference numeral 12 denotes a voltage supply line for supplying a voltage to the organic electroluminescence element 1, and reference numeral 13 denotes a ground. The above-mentioned first to fourth transistors are P channel type FETs.

Next, an operation will be described. In the case in which all the first to fourth transistors in FIG. 9 are the P channel FETs, a positive voltage is applied to the voltage supply line 12 and each voltage shown in FIG. 10 is given to the luminance data line 3, the first control signal line 9, the second control signal line 11, and the selection line 2. First of all, the first transistor 4 is conducted at a time t1 and a pixel constituted by the organic electroluminescence element 1 is selected. At this time, the electric potential of the luminance data line is V0 corresponding to a luminance of zero. At a time t2, the transistor 8 is conducted so that the electric potential difference Vgs on the point g with respect to the point s has a smaller value than a threshold voltage Vt (a negative value) of the second transistor 7. At this time, a current flows to the organic electroluminescence element 1. When the fourth transistor 10 is brought into a non-conduction state at a time t3, electric charges of the capacitor 6 are discharged through the third transistor 8 until the Vgs reaches the threshold voltage Vt of the second transistor 7. At a time t4, the third transistor 8 is brought into a non-conduction state to hold the state of Vgs=Vt by the electric charges of the capacitor.

Next, when the voltage of the luminance data line 3 is changed by a luminance data voltage (a negative value), that is, is decreased to V0+[luminance data voltage] at a time t5, the Vgs is set to a voltage of Vs+Vt obtained by adding the voltage Vs (a negative value) which is proportional to the luminance data voltage and the threshold voltage Vt of the second transistor 7. The first transistor 4 is brought into a non-conduction state at a time t6 and the supply of the luminance data voltage is stopped at a time t7, thereby holding a state of Vgs=Vs+Vt. As shown in the equation, the second transistor 7 is operated as if the threshold Vt of the second transistor 7 becomes zero equivalently to the Vs at this time. In a series of processes, luminance data are written. When the transistor 10 is conducted in this state at a time t8, a current corresponding to the Vs flows to the organic electroluminescence element 1, thereby emitting a light. The light emitting state is maintained until a next data writing operation is carried out. This circuit can independently compensate for the threshold voltage of the second transistor 7 for controlling the current, that is, the luminance of the organic electroluminescence element 1 in each pixel. Therefore, there is an advantage that it is possible to suppress a variation in the luminance caused by a variation in the threshold voltage Vt in the second transistor 7 which controls each pixel.

The driving circuit according to the conventional example shown in FIG. 9 can eliminate the influence of the variation in the threshold voltage Vt in the second transistor 7 corresponding to each pixel on the precision in a luminance, that is, relationship between luminance data and the luminance of the organic electroluminescence element 1. As described in the explanation of the operation, the current flows to the organic electroluminescence element 1 for a period in which the third transistor 8 is brought into the conduction state at the time t2 in FIG. 10 so that the Vgs is set to have a smaller value than the threshold. Furthermore, when the fourth transistor 10 is then brought into the non-conduction state at the time t3, the voltage of the second control signal line 11 is changed. Since the gate electrode of the fourth transistor 10 has a capacitor component, a charging current flows to the capacitor component through the organic electroluminescence element 1. Since the two electrodes interposing the light emitting material of the organic electroluminescence element 1 inevitably act as the electrodes of the capacitor, moreover, the electric charges stored therein flow as a discharging current to the light emitting material of the organic electroluminescence element 1 for the non-conduction period of the fourth transistor 10.

As described above, these currents are generated for a period in which a pixel is selected, and moreover from the time at which the third transistor 8 is brought into the conduction state (t2 in FIG. 10) to the time at which the fourth transistor 10 is brought into the non-conduction state (t3 in FIG. 10), and are noise currents which are not related to a luminance data signal. Consequently, there is a problem that unnecessary light emission is caused to deteriorate precision in a luminance.

The present invention has been made to solve the problem and has an object to provide a spontaneous light emitting type display device having a high precision in a luminance which can prevent the unnecessary light emission of the organic electroluminescence element 1 due to a noise current for the data writing period of each pixel.

DISCLOSURE OF INVENTION

A first aspect of the present invention is directed to a spontaneous light emitting type display device with a driving circuit comprising a selection line for selecting a pixel over which a luminance control is to be carried out, a luminance data line for supplying a voltage corresponding to a luminance, a first transistor which is brought into a conduction state or a non-conduction state in response to a signal of the selection line, a first and a second capacitors for holding a voltage from the luminance data line, a second transistor for controlling a current value of a spontaneous light emitting element, a third transistor for connecting or blocking a gate and a drain in the second transistor, a first control signal line for supplying a signal voltage to control the third transistor into a conduction state or a non-conduction state, a fourth transistor for connecting or blocking the spontaneous light emitting element and the second transistor, a second control signal line for supplying a signal voltage to control the fourth transistor into a conduction state or a non-conduction state, and a voltage supply line for supplying a voltage to the spontaneous light emitting element, wherein the device is provided with a switching element capable of short-circuiting electrodes of the spontaneous light emitting element.

According to such a structure, it is possible to prevent a noise current from flowing in the spontaneous light emitting element, thus offering an effect that a spontaneous light emitting type display device having a high precision in a luminance can be obtained.

A second aspect of the present invention is directed to the spontaneous light emitting type display device according to the first aspect of the present invention, wherein a signal line for supplying a signal to operate the switching element is shared by the selection line or the first control signal line.

According to such a structure, it is possible to produce an effect that the number of the signal lines is reduced and a circuit structure can be prevented from being complicated.

A third aspect of the present invention is directed to the spontaneous light emitting type display device according to the first or second aspect of the present invention, wherein a resistive element is connected in series to the fourth transistor for a period in which the switching element is set in the conduction state.

According to such a structure, it is possible to produce an effect that a current flowing in the transistor is lessened to reduce power consumption.

BEST MODE FOR CARRYING OUT THE INVENTION

Figure 1:
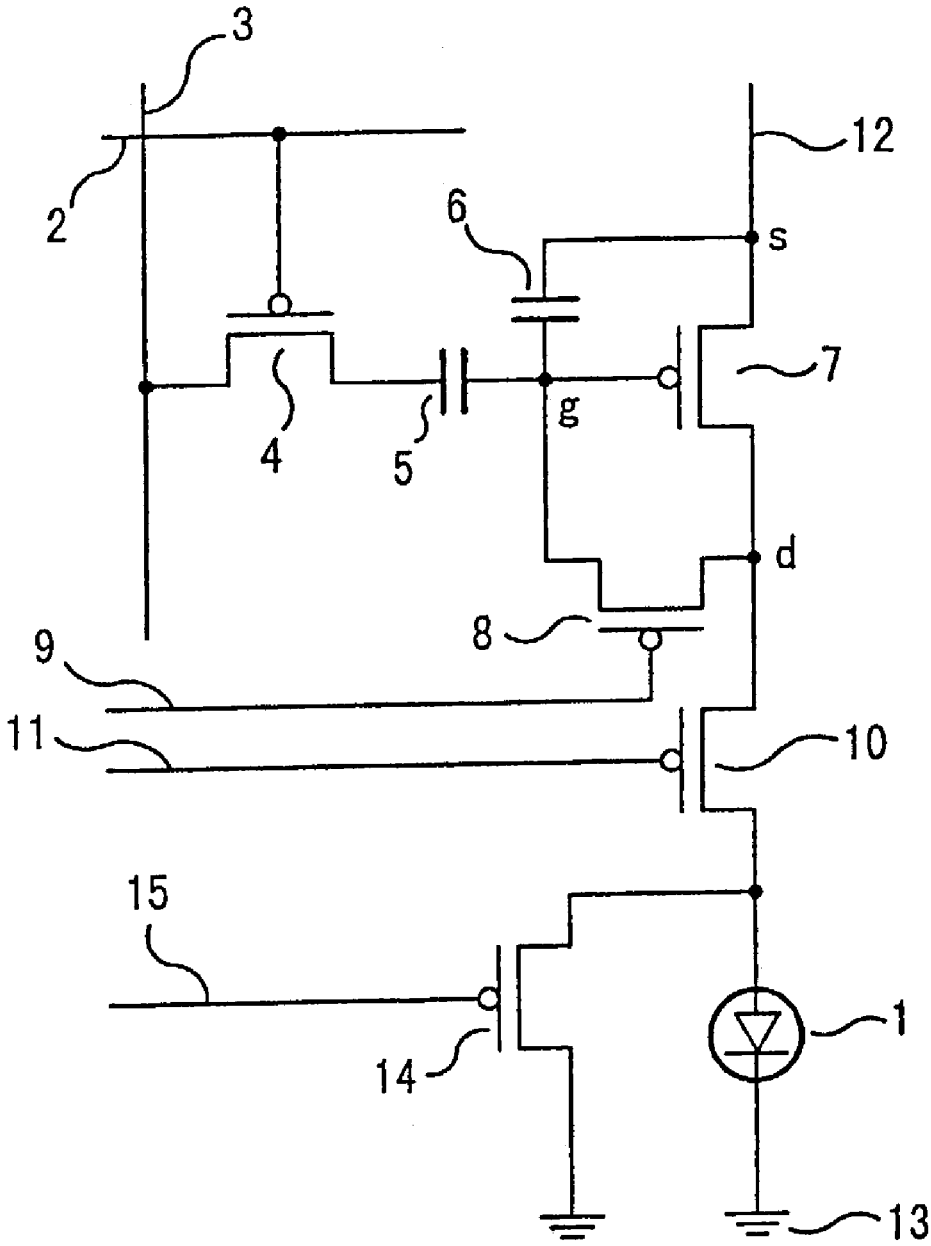
FIG. 1 is a circuit diagram for explaining a driving circuit according to Embodiment 1 of the present invention.

Embodiments of the present invention will be described below with reference to the drawings. In the drawings, the same reference numerals denote the same or corresponding portions.

Embodiment 1

Figure 2:
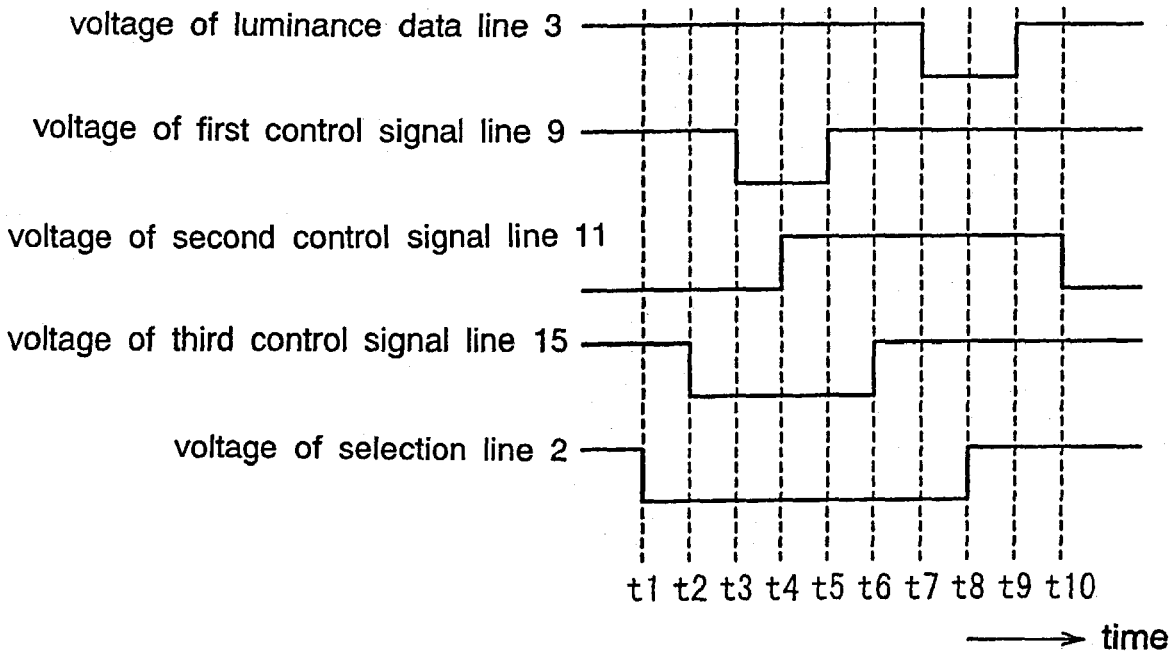
FIG. 2 is a waveform diagram for explaining the operation of the driving circuit according to Embodiment 1 of the present invention.
Figure 9:
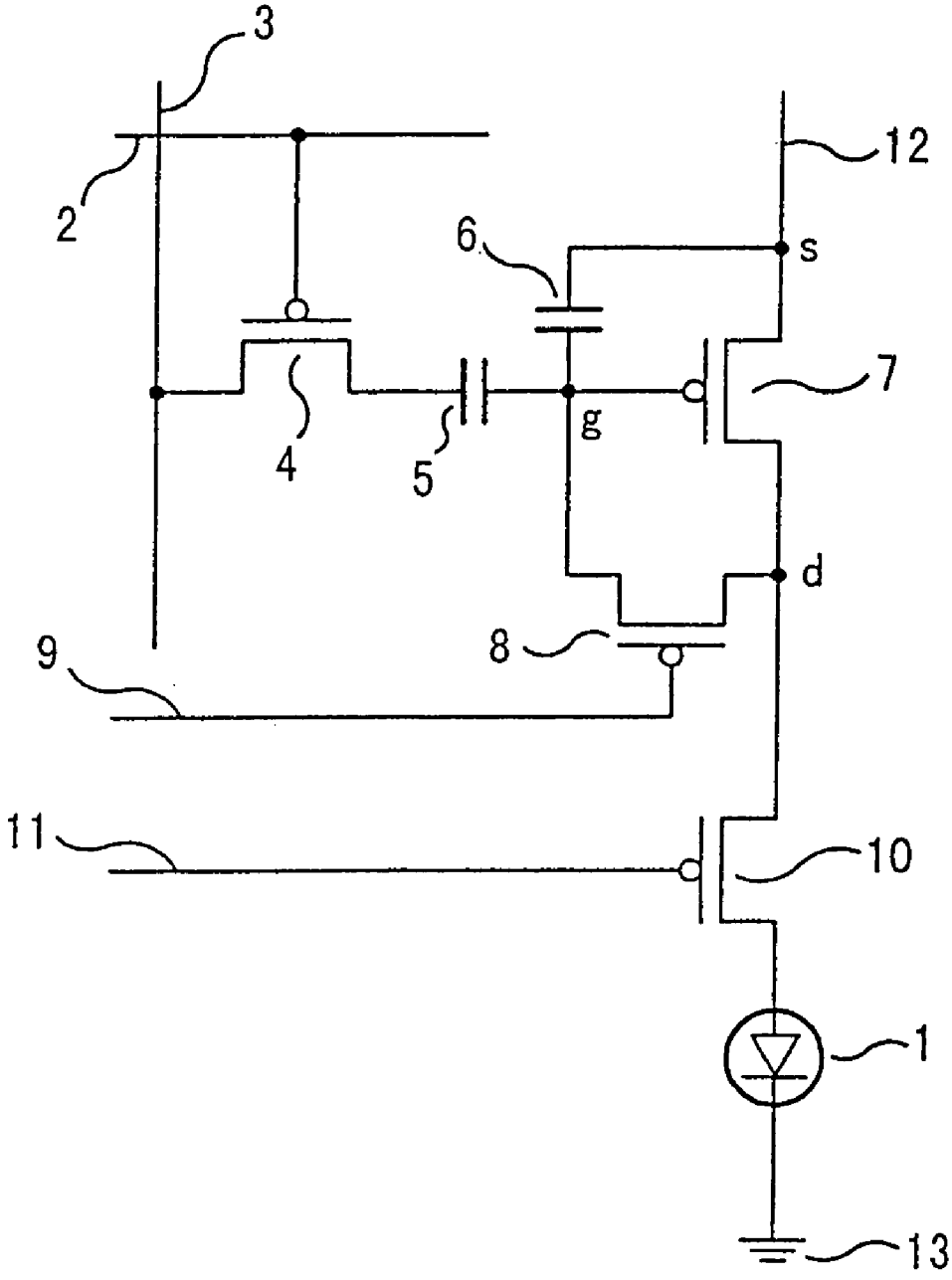
FIG. 9 PRIOR ART
FIG. 9 is a circuit diagram for explaining the conventional driving circuit.

FIGS. 1 and 2 are circuit and waveform diagrams showing a driving circuit and a timing for explaining means for suppressing a noise current according to Embodiment 1 of the present invention. More specifically, FIG. 1 is a circuit diagram showing a driving circuit in the case in which a transistor is applied as a switching element and all the transistors are P channel FETs, and FIG. 2 is a waveform diagram showing the operation timing of each signal voltage in FIG. 1. In FIG. 1, reference numerals 1 to 13 indicate the same components as those in FIG. 9. Reference numeral 14 denotes a fifth transistor to be a P channel FET which is connected in parallel with an organic electroluminescence element 1, and reference numeral 15 denotes a third control signal line for supplying a signal voltage to control the fifth transistor 14 into a conduction or non-conduction state. For the luminance data writing period of the driving circuit in the same figure, the transistor 14 is conducted for a period in which a pixel is selected (t1 to t8 in FIG. 2), and moreover for a period from a time before a transistor 8 is brought into a conduction state (t3) to a time after a transistor 10 is brought into a non-conduction state (t4). By this operation, two electrodes constituting the organic electroluminescence element 1 are short-circuited. While an unnecessary current flows to the organic electroluminescence element 1 for a period in which the third transistor 8 is conducted so that Vgs is set to have a smaller value than a threshold in FIG. 9, the current flows to the fifth transistor 14 and does not flow to the organic electroluminescence element 1 in FIG. 1. Further, when the voltage of a second control signal line 11 is changed to bring the fourth transistor 10 into a non-conduction state in order to cause the Vgs to be equal to the threshold voltage of the second transistor 7, the charging current of the capacitor component of a gate electrode in the fourth transistor 10 flows to the fifth transistor 14 and does not flow to the organic electroluminescence element 1. Moreover, electric charges stored in the two electrodes of the organic electroluminescence element 1 are discharged through the fifth transistor 14. Therefore, a current generated by the electric charges does not flow to the organic electroluminescence element 1.

Figure 10:
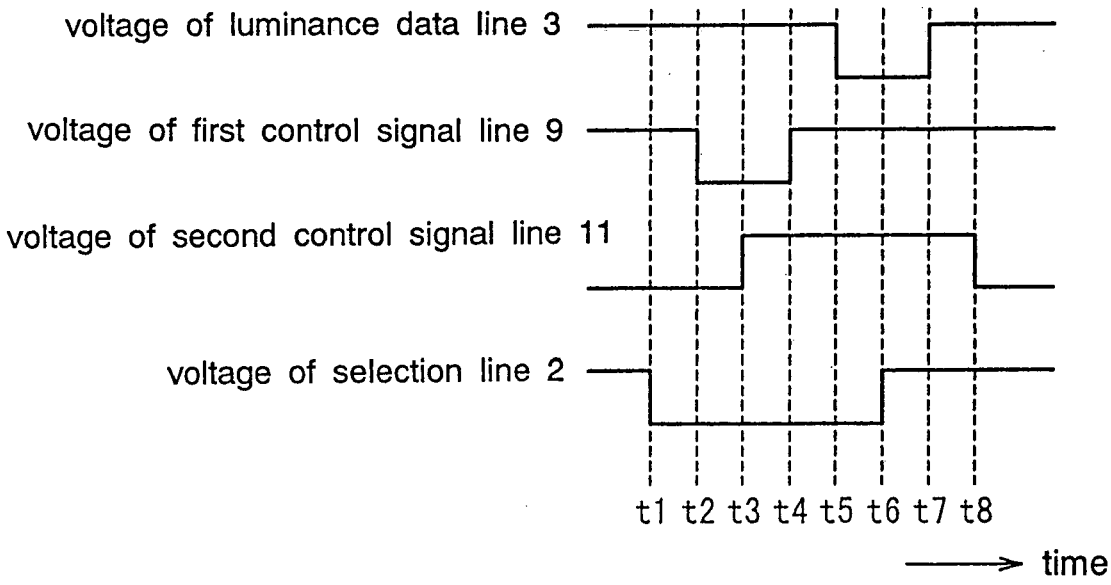
FIG. 10 PRIOR ART
FIG. 10 is a waveform diagram for explaining the operation of the conventional driving circuit.

The operation of the driving circuit shown in FIG. 1 will be described in order of the times t1 to t10 in the waveform diagram of FIG. 2. Before the time t1, data on a pixel have not been rewritten and a current corresponding to luminance data flows to the organic electroluminescence element 1. At the time t1, the first transistor 4 is conducted so that the pixel is selected. At the time t2, the fifth transistor 14 is conducted so that the two electrodes constituting the organic electroluminescence element 1 are short-circuited. Consequently, the current does not flow to the organic electroluminescence element 1 so that light emission is stopped. At the same time, the electric charges stored in the organic electroluminescence element 1 are discharged through the fifth transistor 14. At the time t3, the third transistor 8 is conducted so that the Vgs is set to have a lower voltage than the threshold voltage of the second transistor 7. At this time, a current flows to the fourth transistor 10. However, since the two electrodes constituting the organic electroluminescence element 1 are short-circuited at the time t2, the current flowing in the fourth transistor 10 flows to the fifth transistor 14 and does not flow to the organic electroluminescence element 1. More specifically, the current flowing in the fourth transistor 10 bypasses the fifth transistor 14 for flowing. At this time, a charging current for the capacitor component of the fourth transistor 10 flows to the fifth transistor 14 and does not flow to the organic electroluminescence element 1. At the time t4, the fourth transistor 10 is brought into a non-conduction state so that the Vgs is caused to be equal to the threshold voltage of the second transistor 7. At the time t5, the third transistor 8 is brought into a non-conduction state so that the threshold voltage of the second transistor 7 is held in a second capacitor 6. At the time t6, the fifth transistor 14 is brought into the non-conduction state. Since the fifth transistor 14 does not act on the driving operation of a pixel at the times t7 to t10 in FIG. 2, the driving circuit is operated in the same manner as the conventional driving circuit shown in FIGS. 9 and 10.

While there has been described the case in which all the five transistors in the driving circuit are P channel FETs in Embodiment 1, a part of or all the transistors might be N channel FETs. In that case, it is also possible to obtain the same effects as those in Embodiment 1. It is sufficient that the second transistor 7 is an element having a current control function and the other transistors are elements having a switching function. Thus, the same effects as those in Embodiment 1 can be obtained. Moreover, while the organic electroluminescence element has been used in the spontaneous light emitting element in Embodiment 1, the same effects as those in Embodiment 1 can also be obtained in a spontaneous light emitting type display device using a spontaneous light emitting element such as an inorganic EL.

Embodiment 2

Figure 3:
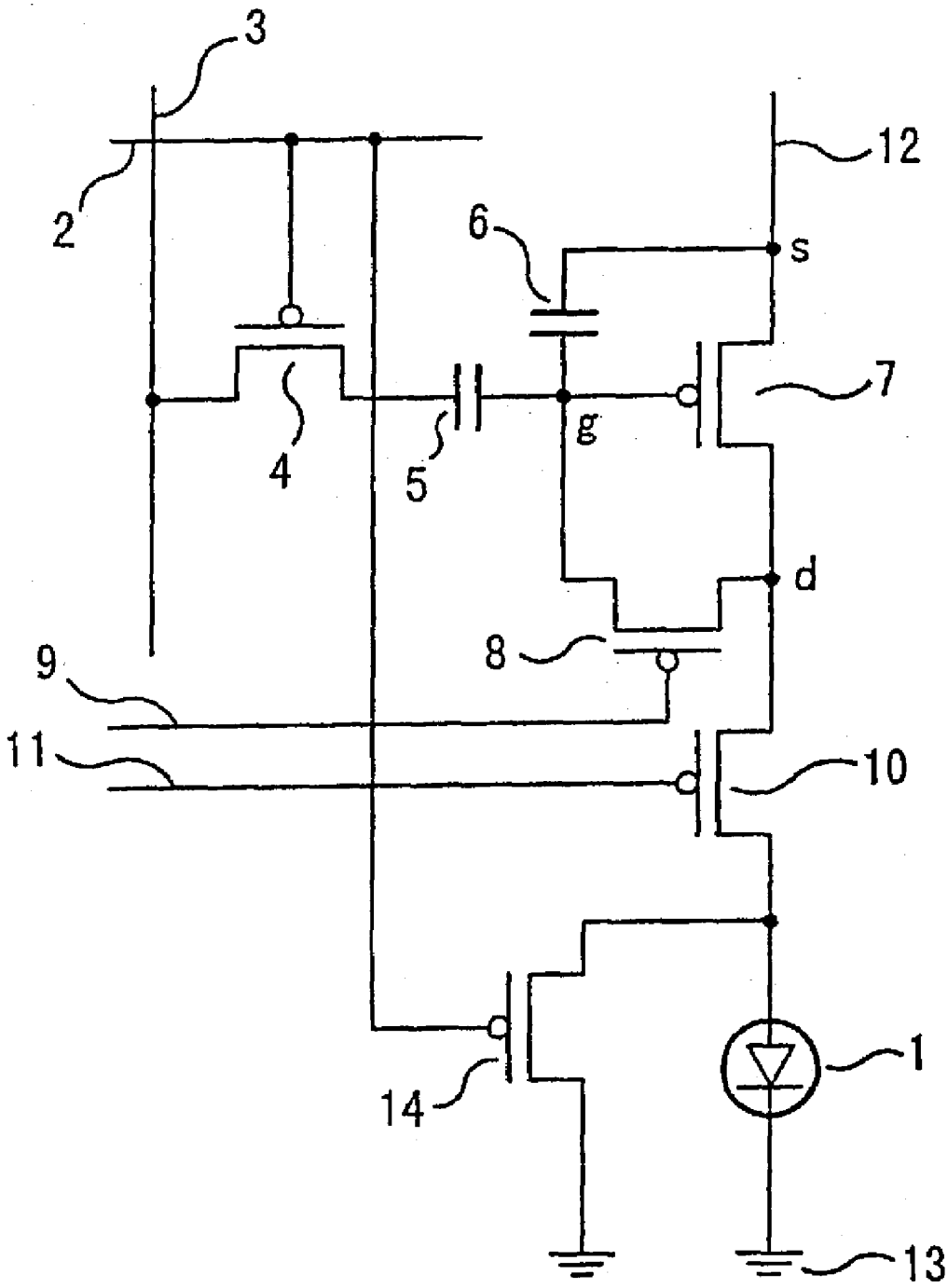
FIG. 3 is a circuit diagram for explaining a driving circuit according to Embodiment 2 of the present invention.

FIG. 3 is a circuit diagram for explaining a driving circuit for suppressing a noise current according to Embodiment 2 of the present invention. In FIG. 3, the third control signal line 15 and the selection line 2 in FIG. 1 are shared. The driving circuit shown in FIG. 3 is operated based on a waveform diagram for explaining an operation timing of FIG. 10. A fifth transistor 14 is conducted for a period in which a pixel is selected, and moreover for a period from a time before a third transistor 8 is brought into a conduction state to a time after a fourth transistor 10 is brought into a non-conduction state. Therefore, the same effects as those in Embodiment 1 can be obtained. Furthermore, it is possible to obtain an effect that the number of the signal lines is decreased and a circuit structure can be thereby prevented from being complicated.

Embodiment 3

Figure 4:
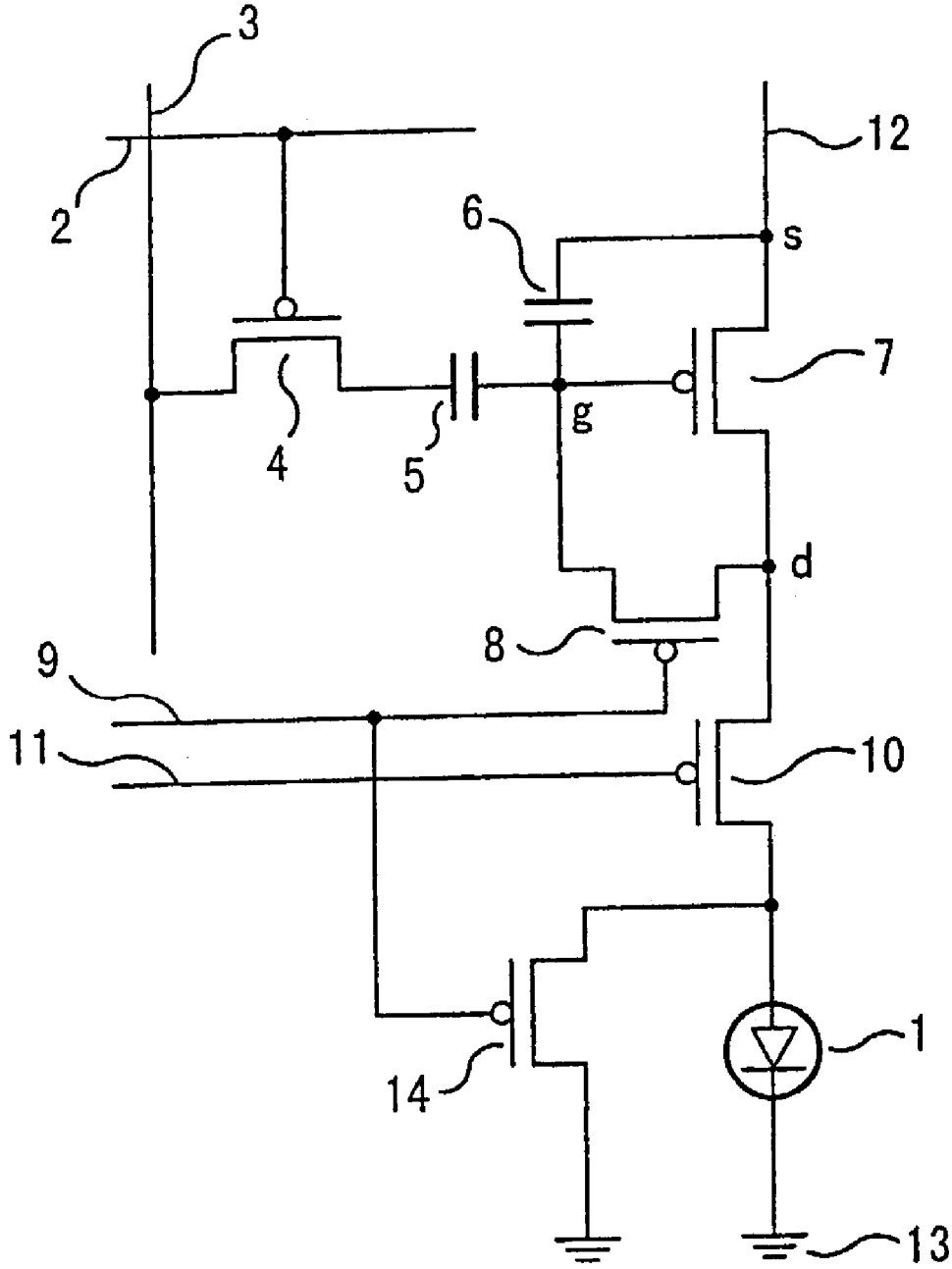
FIG. 4 is a circuit diagram for explaining a driving circuit according to Embodiment 3 of the present invention.

FIG. 4 is a circuit diagram for explaining a driving circuit to suppress a noise current according to Embodiment 3 of the present invention. In FIG. 4, the third control signal line 15 and the first control signal line 9 in FIG. 1 are shared. The driving circuit in FIG. 4 is operated based on a waveform diagram for explaining an operation timing of FIG. 10. A fifth transistor 14 is conducted for a period in which a pixel is selected, and moreover for a period from a time before a third transistor 8 is brought into a conduction state to a time after a fourth transistor 10 is brought into a non-conduction state. Therefore, the same effects as those in Embodiment 1 can be obtained. Furthermore, it is possible to obtain an effect that the number of the signal lines is decreased and a circuit structure can be thereby prevented from being complicated.

Embodiment 4

Figure 5:
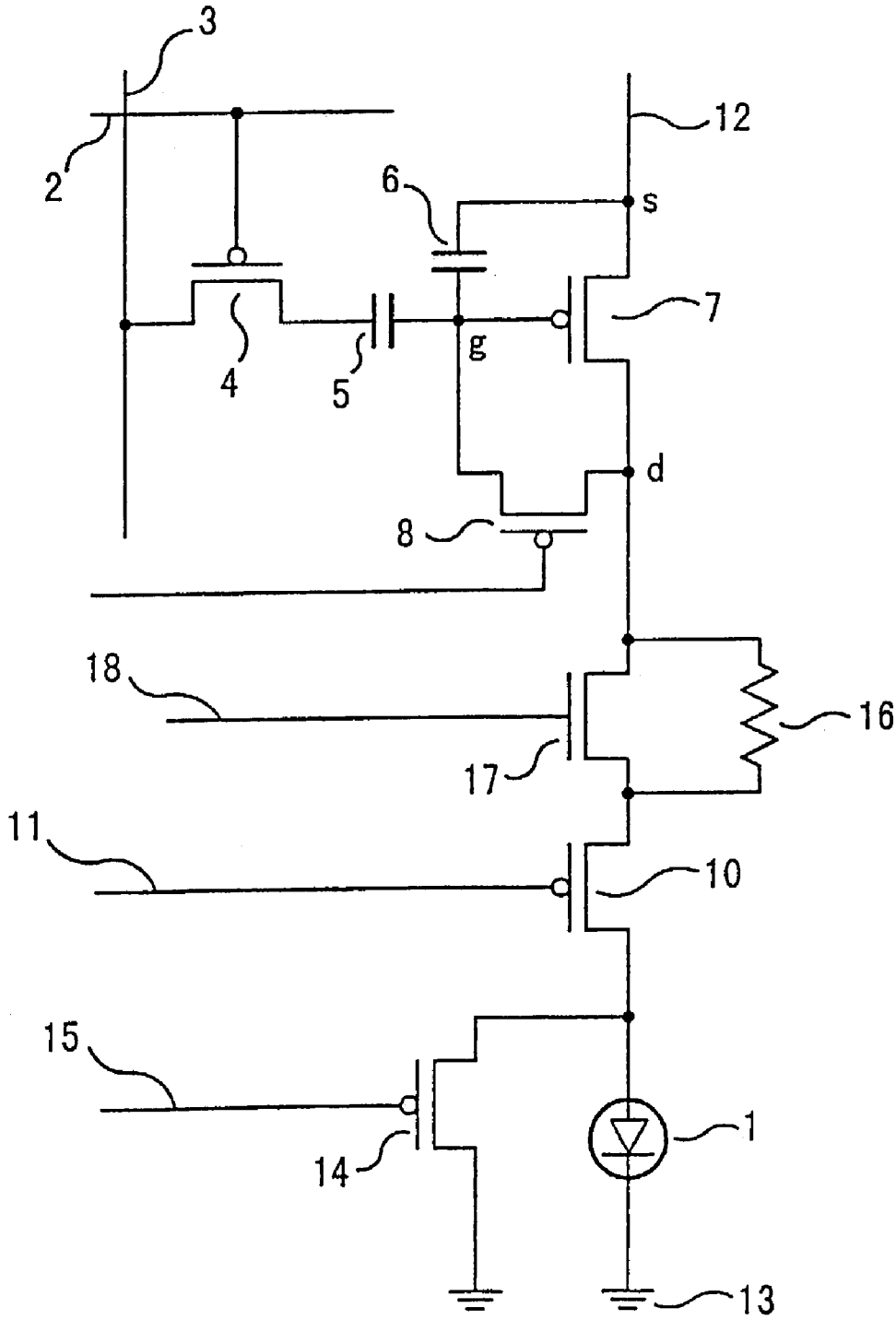
FIG. 5 is a circuit diagram for explaining a driving circuit according to Embodiment 4 of the present invention.

FIG. 5 is a circuit diagram for explaining a driving circuit to suppress a noise current according to Embodiment 4 of the present invention. In FIG. 5, a resistive element 16 is inserted between the second transistor 7 and the fourth transistor 10 in FIG. 1, and a sixth transistor 17 is connected in parallel with the resistive element 16. The driving circuit in FIG. 5 is operated based on the timing chart of FIG. 2 and the sixth transistor 17 is brought into a non-conduction state for a period in which at least a fifth transistor 14 is set in a conduction state, and is brought into the conduction state for other periods. As a result, in addition to the same effects as those in Embodiment 1, it is possible to obtain an effect that a current flowing to the second, fourth and fifth transistors 7, 10 and 14 can be lessened to reduce power consumption for a period in which a third transistor 8 is brought into the conduction state so that Vgs is set to have a smaller value than a threshold, because the resistive element 16 is inserted in series to the fourth transistor 10 for a period in which the fifth transistor 14 is set in the conduction state.

Embodiment 5

Figure 6:
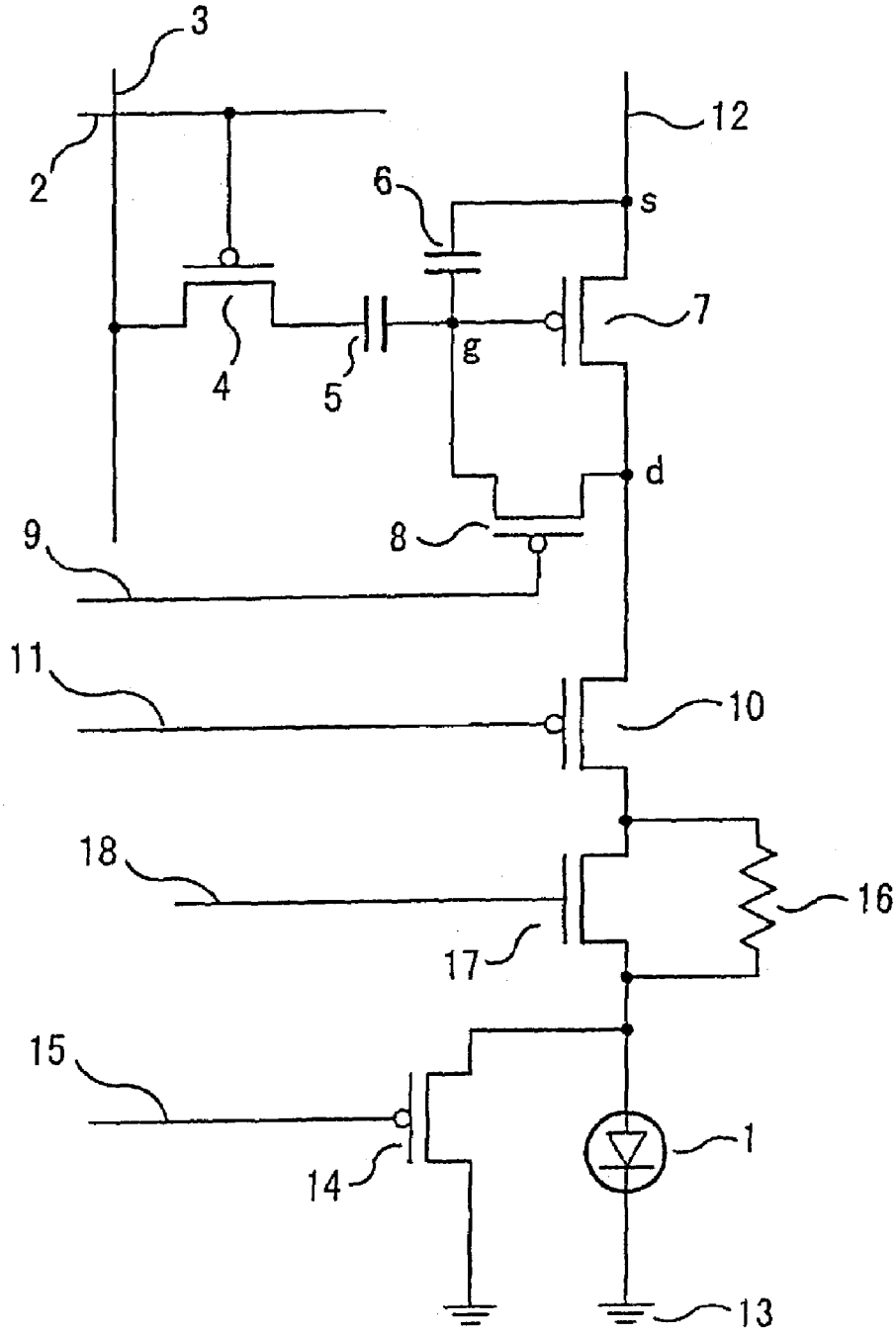
FIG. 6 is a circuit diagram for explaining a driving circuit according to Embodiment 5 of the present invention.
Figure 7:
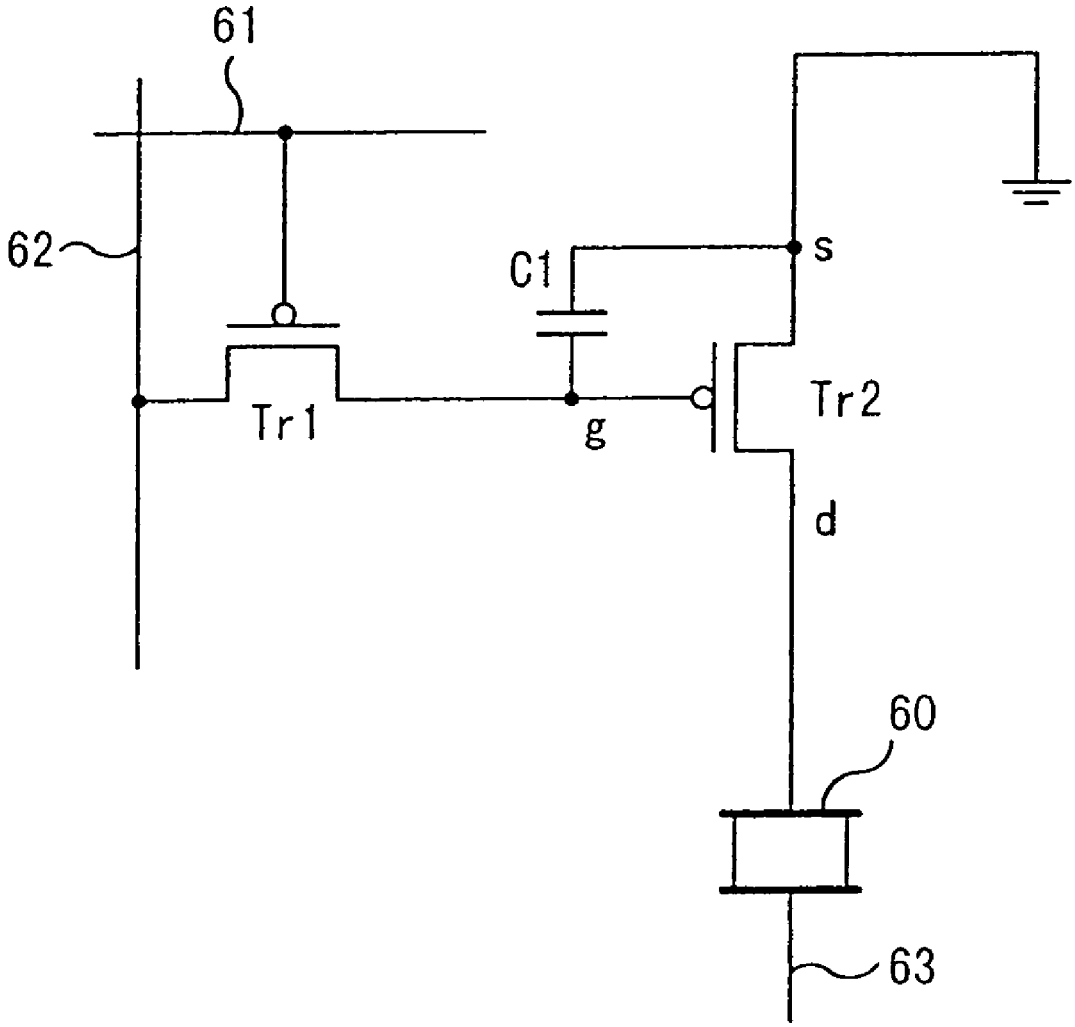
FIG. 7 PRIOR ART
FIG. 7 is a circuit diagram for explaining a conventional driving circuit.
Figure 8:
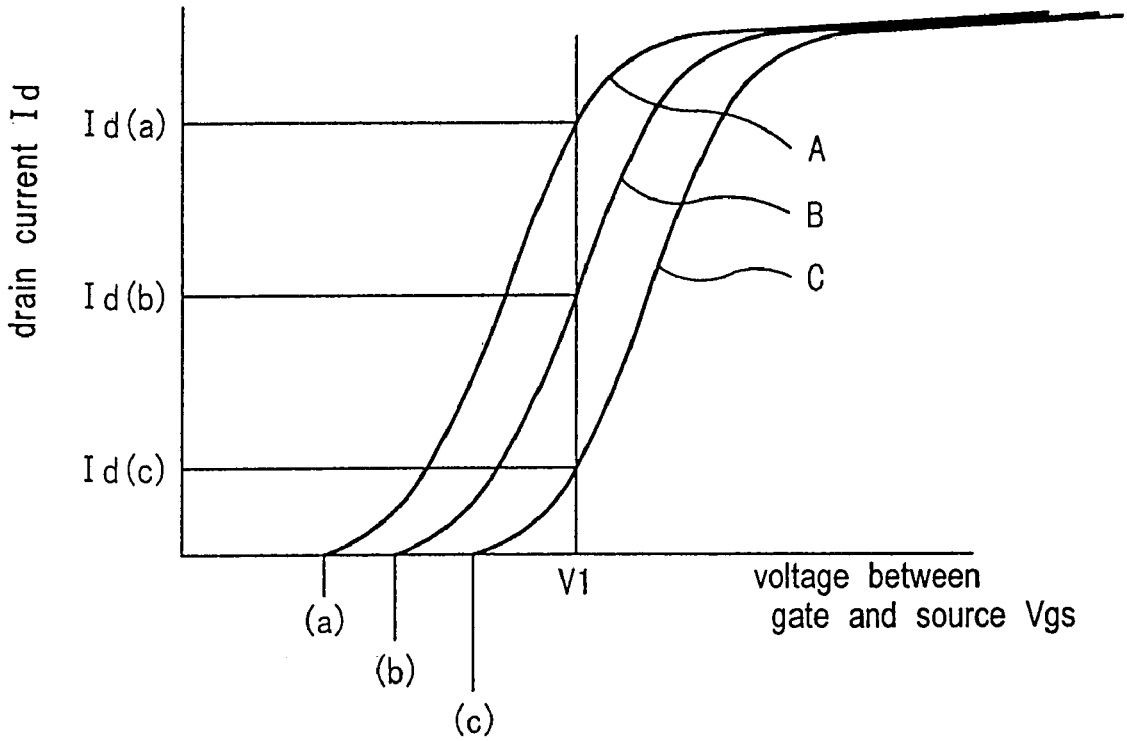
FIG. 8 PRIOR ART
FIG. 8 is a characteristic chart for explaining the relationship between a threshold voltage and a drain current in a transistor for controlling the current of a conventional light emitting element.

FIG. 6 is a circuit diagram for explaining a driving circuit to suppress a noise current, illustrating Embodiment 5 according to the present invention. In FIG. 6, a resistive element 16 is inserted between an organic electroluminescence element 1 and the fourth transistor 10, and a sixth transistor 17 is connected in parallel with the resistive element 16. The driving circuit in FIG. 6 is operated based on the timing chart of FIG. 2, and the sixth transistor 17 is brought into a non-conduction state for a period in which at least a fifth transistor 14 is set in a conduction state, and is brought into the conduction state for the other periods. As a result, in addition to the same effects as those in Embodiment 1, it is possible to obtain an effect that a current flowing to second, fourth and fifth transistors 7, 10 and 14 can be lessened to reduce power consumption for a period in which a third transistor 8 is brought into the conduction state so that Vgs is set to have a smaller value than a threshold, because the resistive element 16 is inserted in series to the fourth transistor 10 for a period in which the fifth transistor 14 is set in the conduction state. Furthermore, it is possible to obtain an effect that a charging current flowing to the capacitor component of the fourth transistor 10 can be lessened to reduce the power consumption.

In the fourth and fifth embodiments, the sixth transistor 17 might be an N channel FET if the fifth transistor 14 is a P channel FET, or the sixth transistor 17 might be the P channel FET if the fifth transistor 14 is the N channel FET. Thus, by employing a structure in which conduction and non-conduction are reversed to each other in response to the same control signal, the fourth control signal line 18 can be shared with the third control signal line 15 in FIGS. 5 and 6. Consequently, it is possible to decrease the number of the control signal lines. Moreover, this structure can also be applied to Embodiment 2 or Embodiment 3.

While the organic electroluminescence element has been taken as an example of an electroluminescence element in the description of Embodiments 2 to 4, it is possible to obtain the same effects by using another spontaneous light emitting element such as an inorganic EL.

INDUSTRIAL APPLICABILITY

The present invention has a feature that a noise current flowing in a light emitting element can be suppressed so that precision in a luminance can be enhanced. Thus, the present invention can be utilized effectively for a spontaneous light emitting type display device.

The invention claimed is:

1. A spontaneous light emitting display device with a driving circuit comprising:

a selection line for selecting a pixel over which a luminance control is to be carried out, a luminance data line for supplying a voltage corresponding to a luminance, a first transistor made conducting or non-conducting in response to a signal of the selection line, first and second capacitors for holding a voltage from the luminance data line, a spontaneous light emitting element, a second transistor including a gate and a drain, the second transistor for controlling current supplied to the spontaneous light emitting element, a third transistor for connecting or blocking the gate and the drain of the second transistor, a first control signal line for supplying a signal voltage to control the third transistor to conduct or not to conduct, a fourth transistor for connecting or blocking the spontaneous light emitting element and the second transistor, a second control signal line for supplying a signal voltage to make the fourth transistor conduct or not conduct, a voltage supply line for supplying a voltage to the spontaneous light emitting element, and a switching element connected in parallel with the spontaneous light emitting element for short-circuiting the spontaneous light emitting element.

2. The spontaneous light emitting display device of claim 1, wherein a signal line for supplying a signal to operate the switching element is shared by the selection line.

3. The spontaneous light emitting display device of claim 1, including a resistive element connected in series to the fourth transistor for a period in which the switching element is conducting.

4. The spontaneous light emitting display device of claim 2, including a resistive element connected in series to the fourth transistor for a period in which the switching element is conducting.

5. The spontaneous light emitting display device of claim 1, wherein a signal line for supplying a signal to operate the switching element is shared by the first control signal line.

6. The spontaneous light emitting display device of claim 1 further comprising, as the spontaneous light emitting element, an organic light emitting element.

* * * * *